United States Patent [19]

Ellis

[11] Patent Number: 4,730,472

[45] Date of Patent: Mar. 15, 1988

[54] HYDRAULIC CONTOURING MEANS FOR A HOT OR COLD LEVELER MACHINE

[75] Inventor: Robert H. Ellis, Oakmont, Pa.

[73] Assignee: United Engineering, Inc., Pittsburgh, Pa.

[21] Appl. No.: 884,151

[22] Filed: Jul. 10, 1986

[51] Int. Cl.[4] ..... B21B 37/08; B21D 1/02

[52] U.S. Cl. ..... 72/8; 72/21; 72/164

[58] Field of Search ..... 72/163–165, 72/8, 21, 35, 241, 245

[56] References Cited

U.S. PATENT DOCUMENTS

| | | | |
|---|---|---|---|
| 1,911,321 | 5/1933 | Long | 72/164 |
| 2,429,142 | 10/1947 | Thomas | 72/164 |
| 3,559,432 | 2/1971 | Rastelli | 72/21 |
| 3,596,489 | 8/1971 | Ball | 72/241 |
| 3,906,767 | 9/1975 | Tanaka et al. | 72/21 |
| 4,454,738 | 6/1984 | Buta | 72/164 |
| 4,468,944 | 9/1984 | Foss | 72/248 |
| 4,481,800 | 11/1984 | Ruhl | 72/21 |

FOREIGN PATENT DOCUMENTS

| | | | |
|---|---|---|---|
| 778805 | 3/1935 | France | 72/163 |
| 1322397 | 7/1973 | United Kingdom | 72/35 |

*Primary Examiner*—Daniel C. Crane

*Attorney, Agent, or Firm*—Dennison, Meserole, Pollack & Scheiner

[57] ABSTRACT

A hot or cold leveler is provided having conventional high loaded driven work rolls backed up longitudinally across their face by a plurality of short backing rolls. A series of lower work and backing rolls are cassette mounted on the lower main frame of the leveler. The upper backing rolls are mounted on an intermediate support frame designed for limited flexure and which in turn is supported across its length by a plurality of hydraulic piston-cylinder assemblies fixed in the top main frame of the leveler for contouring of the leveling action. Each cylinder is controlled by a servo valve which can be operator-adjusted to work the sheet material across its width dependent on sheet flatness. Buckling at the center, quarter, or edges of the sheet can be removed by a corrective positioning of the piston-cylinder in the location of the buckle. Entry and delivery rollers are similarly servo-controlled. The entry roll is backed off to permit the sheet product to enter the machine and it acts as an anvil roll. The delivery roll is adjusted to deliver flat product onto a delivery table. Pressure transducer means and piston position transducer means are provided in each cylinder, whereby a positive feedback signal is provided due to loads on the flexible beam exerted by the material being worked to withdraw or inject hydraulic fluid to the cylinders.

24 Claims, 4 Drawing Figures

HYDRAULIC CONTOURING MEANS FOR A HOT OR COLD LEVELER MACHINE

BACKGROUND OF THE INVENTION

This invention relates broadly to the art of flatening or leveling of metal webs or strip by passing the same between opposed groups of offset rollers. Such machines for this purpose are referred to in the art as levelers, flatteners, or straighteners and all perform essentially the same function in the same general manner.

For the purposes of background, the following U.S. patents may be referred to: Peterson U.S. Pat. No. 2,852,065; Krynytzky U.S. Pat. No. 2,963,071; Bearer U.S. Pat. No. 3,301,031; Thompson et al U.S. Pat. No. 3,638,326; Talbot 3,657,913; Ihle U.S. Pat. No. 4,107,970; and Matsui U.S. Pat. No. 4,380,921.

The basic operation theory of a leveler machine is well known. Metal is formed into strip form from a heated or cold billet or slab by passing the material between a pair of work rolls in a rolling mill to reduce the cross-section and to elongate the same. When the final thickness is achieved, and the strip exits from the mill, it is occasionally wrapped convolutely to form a coil. When it is desired to uncoil the material, a certain curvature or set remains which of course varies dependent on the radius of the portion of the strip in the coil.

It will of course be apparent that the outermost convolution will have less curvature than the innermost convolution. The leveler is designed to remove this curvature so that the strip is perfectly flat and suitable for other machining and manufacturing steps.

While the present invention could be used for removing curvature from rolled sheet material, its principal utility is for working relatively thick sheet or plate that has not been convolutely wound.

In addition to coil curvature, the sheet could have other defects such as edge waves caused by the edges being rolled thinner than its center, or "oil canning" when the reverse is true because the center was rolled thinner than the edges. In most prior art levelers, the strip is passed through a combination of rollers which provide a predetermined amount of reverse flexure sequentially diminishing as the web passes through the leveler to remove curvature and other shape defects.

In operation of the conventional leveler, as the strip passes between the rolls, a very high pressure is generated and this results in the strip tending to wedge the roll pairs apart. Accordingly, back-up rolls are provided.

Heretofore, it has been necessary for the leveler operator to carefully monitor the work roller position during the material pass, and high quality product was, to a large degree, dependent upon the skill of the individual operator.

Almost all prior art levelers include an upper and a lower series of work rollers which extend across the machine from one side frame to the other. Each series of rollers are positioned in parallel from the entry to the exit point. The upper and lower rollers are offset with respect to each other so that the web or strip passes in a tortuous path from entry to exit. In the prior art the adjustment of the vertical spacing between the upper and lower rollers is accomplished by means of wedges, jack screws or the like.

Very little development has been made to date in the field of automation of strip levelers. Two examples, however, are Buta U.S. Pat. No. 4,454,738 and Ball U.S. Pat. No. 3,596,489.

DESCRIPTION OF THE INVENTION

In order to provide at least semi-automatic operation of a leveler for strip metal, I have mounted the upper back-up rolls on a partially flexible beam support extending parallel to the axes of the rolls which in turn is mounted to the leveler rigid frame through a plurality of piston-cylinder units with the piston members thereof in contact with the flexible beam support and the cylinders mounted on the rigid leveler frame. A position feedback transducer in each cylinder senses the position of the respective piston and sends a position feedback signal to a summing amplifier which compares this to a reference position signal and by actuation of a servo valve, can inject or allow outflow of hydraulic fluid into or out of the cylinder so as to maintain the proper preset piston position of the system if set for operation in the "position mode."

With my invention, a sheet having a width of about 3.66 meters, a length of 15 meters, and a thickness of between approximately 4.76 mm to 50.8 mm may be worked hot and a thickness of 4.76 mm to 25.4 mm may be worked in the cold state.

OBJECTS OF THE INVENTION

The principal object of my invention is to provide a leveler for sheet metal having means to detect back-up roller beam deflection and to produce a counter force on the beam to automatically resist such deflection in order to produce a substantially flat sheet product.

Another important object of my invention is to provide a plurality of hydraulic piston-cylinder units for mounting the back-up roller support beam on the main frame of a leveler wherein means are provided to automatically maintain piston position in the cylinder by injecting or venting hydraulic fluid into or out of the respective cylinder.

An object of my invention is to improve sheet or plate levelers by mounting the upper backing rolls on an intermediate frame which may be partially deflected in use and which is supported on the main frame of the leveler across its length by a plurality of contouring hydraulic cylinder units which are individually position controlled by servo valves and which can be adjusted to work the sheet metal across its width to different degrees dependent on flatness of the sheet or plate.

A further object is to provide a safe reliable, control system for levelers which utilizes commercially available components and which produces a high quality level of final product consistently and which requires a minimum of maintenance.

These and further objects will be readily apparent to those skilled in the art of metal rolling from a study of the detailed descriptions of the specification and drawings which follow.

DETAILED DESCRIPTION OF THE INVENTION

Figure 1:
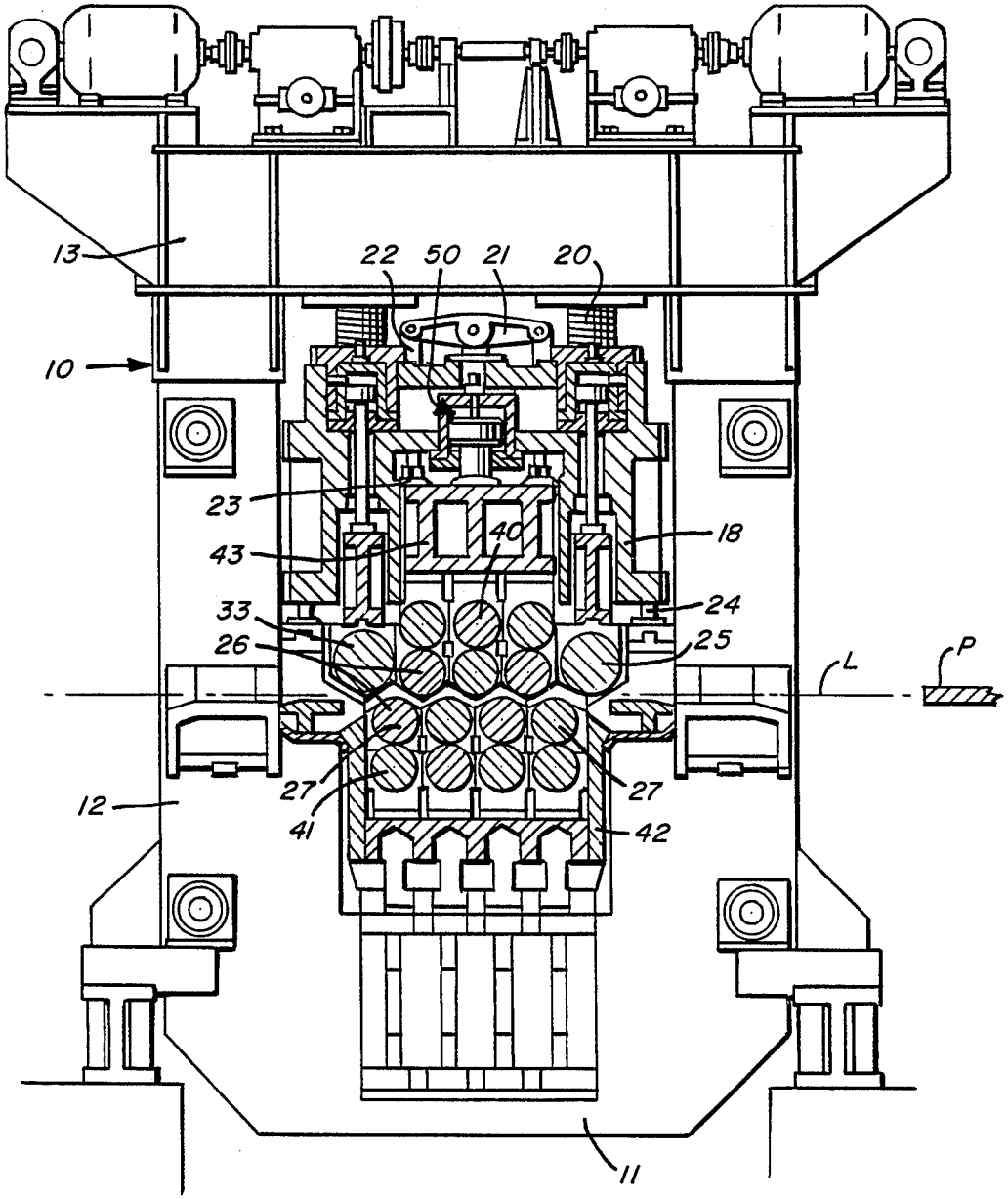
FIG. 1 is a sectional side elevation of a preferred embodiment of the leveler of my invention.

With reference to the drawings, wherein like parts are designated with the same reference characters, the basic leveler is shown generally at 10 and includes a heavy steel base frame 11 and upstanding steel side frame members 12. A top frame assembly 13 is secured to the side frame members as is common in the art. The upper frame supports a screw adjustment assembly 14 which may be actuated by a worm gear 15 via a drive shaft 16 rotated by the electric motor 17. This arrangement permits vertical adjustment of rigid top subframe 18 which is engaged with the foot 19 of screw 20. A piston assembly serves to force the rigid top subframe 18 against the foot 19 of screw 20. In FIG. 1 this piston assembly is shown somewhat schematically at 24 where it reacts against the base frame 11 and the rigid subframe 18. This arrangement is shown in greater detail in Thompson et al U.S. Pat. No. 3,638,326.

The sheet or plate to be worked passes into the leveler from the right in FIG. 1 as shown at P and moves along the pass line L. After passing beneath an entry roll 25 it passes between an upper and lower series of work rollers 26 and 27. Each of these rollers are separately driven by a motor, not shown, through drive shafts 28 and 29 and universal joints 30 and 31. Each of the upper and lower work rollers 26 and 27 are journalled in bearings 32.

At the exit point on pass line L, a delivery roll 33 is mounted, which, like entry roll 25, may be larger in diameter than the work rolls 26 and 27, and is not necessarily backed up.

While three upper work rolls 26 and four lower rolls 27 are shown, it will be apparent that a greater or lesser number may be selected dependent on the particular situation. The upper and lower rollers are offset with respect to each other and may be adjusted so that they may be brought into substantially nesting relationship with each other. The spacing between the upper and lower rollers, referred to as the gap or roller "plunge" is adjustable and each bank of rollers can even be tilted as required to provide an increasing or decreasing gap from front to back. This is accomplished by electromechanical screws or hydraulic cylinders.

Because of the high working pressures encountered, each of the working rolls 26 and 27 is provided with a backing roll 40 and 41. Hydraulic cylinders 34 and 35 serve to hold the working rolls 26, 27 snugly against the backing rolls. The lower work rolls 27 and their backing rolls are mounted in a roll change cassette 42 as is known in the art, which rests on the leveler base frame 11. The upper backing rolls 40 are journalled and supported by a flexible intermediate beam 43 which extends across the width of the machine (FIG. 2) parallel to the working rolls and which in turn is mounted by means of piston-cylinder units shown generally at 50 to the top subframe 18. Similar piston-cylinder assemblies are also provided to back-up the entry roll 25 and the delivery roll 33 although these are not provided with backing rollers.

Figure 2:
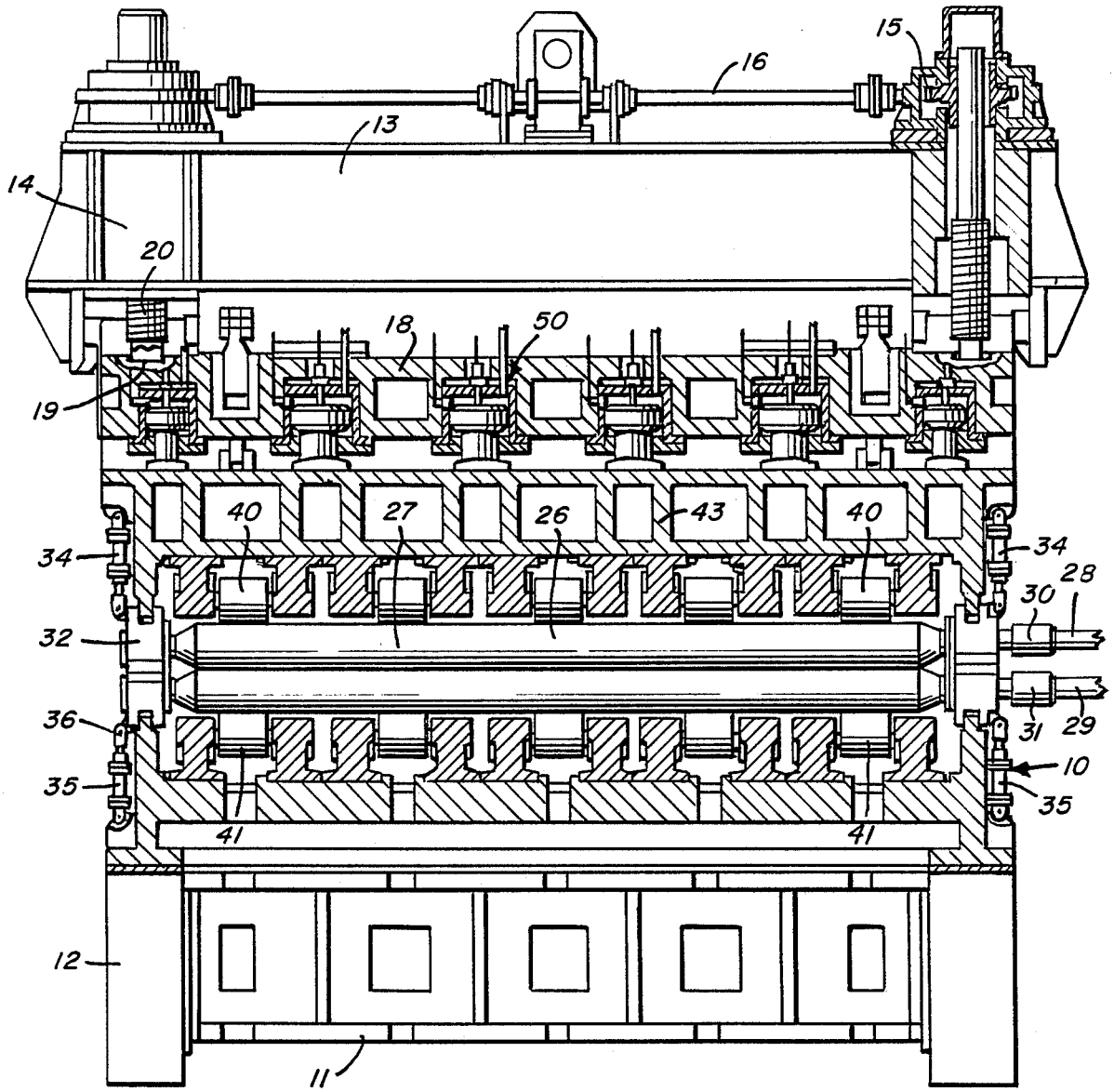
FIG. 2 is a front elevational view of the invention shown in FIG. 1.

In FIGS. 1 and 2, a hydraulic-actuated pivoted lever 21 is shown acting on links 22 which in turn are secured to the flexible beam 43 at 23 for the purpose of forcing the flexible beam upwardly.

Figure 3:
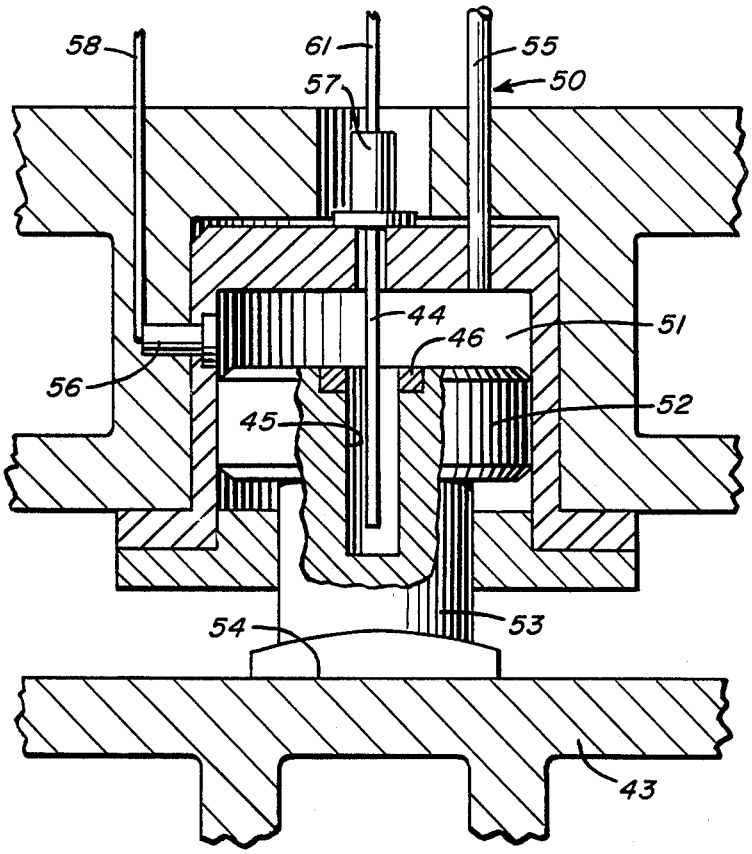
FIG. 3 is a detailed enlarged view of one of the piston-cylinder beam mounting assemblies shown in FIG. 2.

The cylinders 51 are machined into the subframe 18 or provided by sleeving, see FIG. 3. A piston 52 is received in each cylinder and has its piston rod or shaft 53 in contact with the beam 43 as at 54, so that any flexure of the beam 43 caused by the pressure imparted to the rolls 26, 40 will cause concurrent movement of the rod 53 and the piston 52 within the cylinder 51.

A hydraulic inlet and outlet line 55 extends from the servo valve of the control circuit into each of the cylinders. The cylinders are otherwise closed but are each provided with a fluid pressure transducer 56 and a linear position-displacement transducer 57.

The fluid pressure transducer 56 may be of any conventional design, although the model P563 manufactured by George Kelk Limited of Don Mills, Ontario, Canada has been found to be ideal for this application and is fitted into the cylinder side wall with the four conductor shielded cable 58 extending to a video display unit 59 for graphic depiction of the cylinder fluid pressure. This type of transducer operates in the manner of a strain gauge which permits the use of D.C. excitation ensuring rapid response and providing good linearity and low hysteresis.

The linear position-displacement transducer is also a component available on the commercial market and is installed in the top of each cylinder. I have found that the units manufactured by Temposonics Division, MTS Systems Corporation of Plainview, N.Y. (U.S. Pat. No. 3,898,555) are suitable for this purpose. These devices utilize a waveguide and external magnet as described in detail in the above patent. The hollow transducer tube 44 having a wire therein extends into the cylinder and into a bore 45 formed in the head of piston 52.

An annular ring magnet 46 surrounds bore 45 in the piston head in a manner known in the art. When a current pulse is sent through the wire, the resulting magnetic field is concentratedin tube 44 which acts as a waveguide. This causes an interaction with the field from magent 46 and a local rotary strain. This strain continues for the duration of the current pulse. The rotary strain travels along the waveguide element at ultrasonic speed and can be detected at the end of the tube. By measuring the time from the generation of the initial electrical pulse until the ultrasonic pulse is detected, determination may be made of the distance from the reference point. Devices of this type are commercially available as noted, supra.

Figure 4:
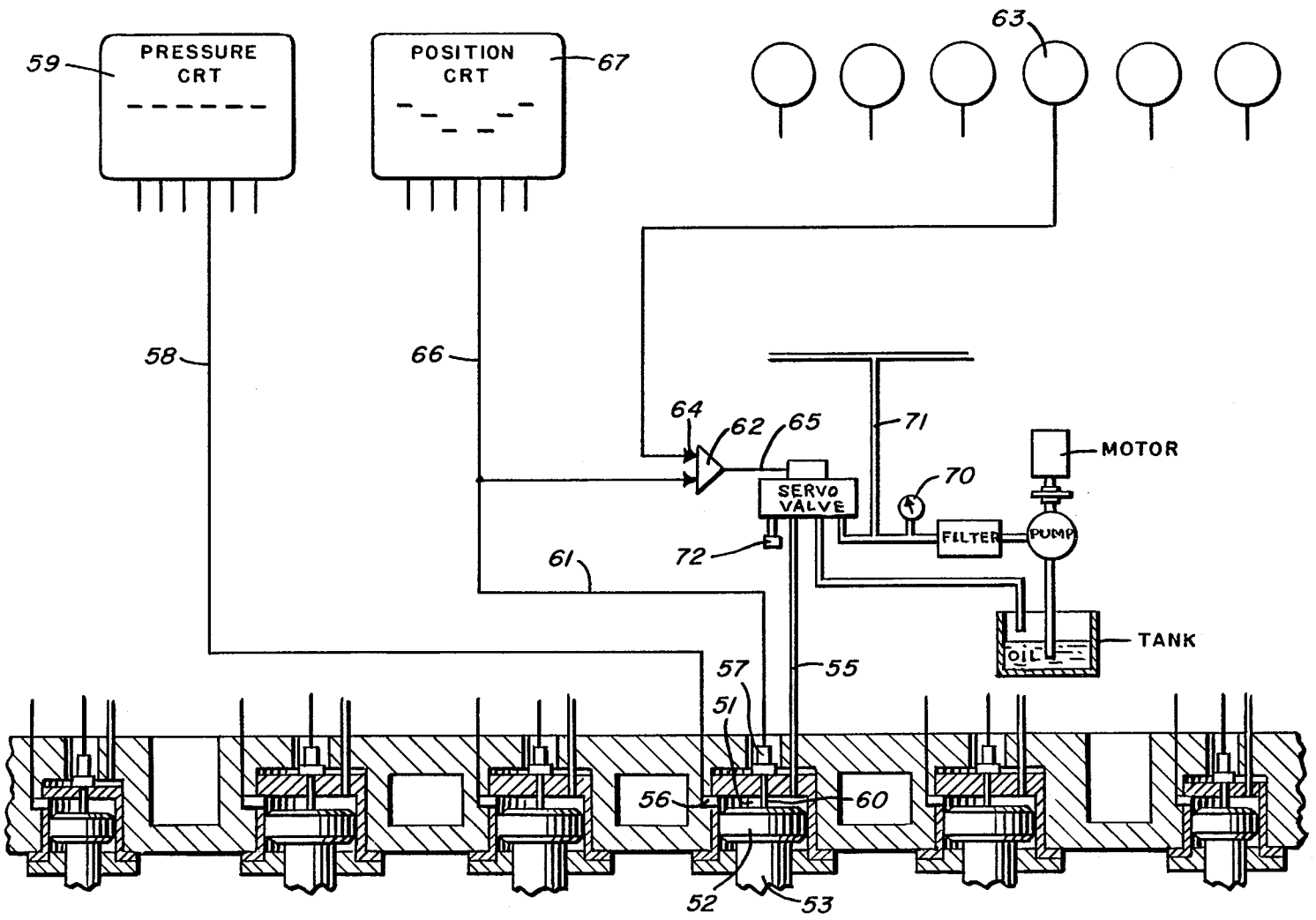
FIG. 4 is a schematic presentation of the electrical and hydraulic control circuits of my new leveler.

Any apparent piston movement, as for example would occur from deflection of beam 43, will result in an analog output signal in the lead 61. Using this system, a pulse generator produces a series of pulses, each also used to set a bistable flip flop. Setting the flip flop closes a switch, permitting the application of a D.C. reference voltage to the input of a summing amplifier 62 (FIG. 4). A base reference position or null adjusting potentiometer 63 is used to provide a bias voltage to a second input 64 of the summing amplifier 62 to provide a voltage subtraction. The D.C. output voltage is preferably filtered and may be further amplified before it is fed to the servo valve.

If desired, the output from the position-displacement transducer 57 may also be fed through cable 66 to a piston position video display console 67 located adjacent to the pressure video display 59. Here the operator will have a graphic presentation of both pressure and piston position in each of the piston-cylinder units 50.

The hydraulic system includes a fluid supply resevoir or tank, a motor-driven pump, line filter and system pressure gauge 70. A manifold 71 is used to direct fluid flow into and out of each of the servo valves in the system, only one being shown in FIG. 5 for purposes of simplicity. The servo valve also is provided with a capped port 72.

In order to operate the system in a "pressure mode"; the reference position potentiometers 63 are adjusted so that the pistons are all at the same level in the cylinders 51 and the pressure display screen 59 and the piston position screen 67 will each show the individual lines at the same level. As sheet material advances into the leveler, any forces created by the material against the work rollers 26 should ideally be the same, however, if variations in thickness or buckling is present, there will be a variation in the pressures against the working roll nearest the defect which will be transferred to its backing roll and then tend to deform or flex the beam 43. This flexure causes concurrent movement upwardly of the piston 52 adjacent the effected portion of the beam. Piston movement is sensed immediately by the position-displacement transducer 57 sending a position feedback analog signal to the summing amplifier 62 which compares this input to that at 64 from the reference position signal. The output from the amplifier then actuates the servo valve and the pump motor to direct hydraulic fluid under pressure to the effected cylinder or vent cylinder pressure via the line 55 thereby varying the fluid pressure above the piston, restoring it to its initial position to counter the loading on the work roll from the sheet material.

If, on the other hand, it is desired to work the material in a same special manner, as for example, to provide a narrow dishing effect the system can be operated in a "position mode." Here the operator, by manually controlling the reference position potentiometers, can select the appropriate piston position as seen on the graphic display 67 in the example shown in FIG. 4. Thereafter, the system will apply or remove hydraulic pressure as needed to maintain the desired product configuration.

It will be apparent from the above description that I have provided for substantially automatic leveler operation by a new and simple mechanical and electrical means which will produce a high quality product at lower cost than prior art machines. Other modifications, embodiments and improvements will be readily apparent to those skilled in the art based upon these teachings. Such further modifications, embodiments and improvements are deemed to be within the spirit and scope of the invention as defined in the following claims:

I claim:

1. In a sheet metal leveling machine having a rigid frame, a plurality of parallel upper and lower working rolls journalled for rotation in said frame for receiving, the sheet material to be worked between opposed pairs of rolls which are offset with respect to one another a flexible subframe subject to distortion due to forces imparted thereto by either of said sets of working rolls when the sheet material passes in contact therewith, and means to compensate for said distortion; the improvement comprising, said flexible subframe extending across said machine substantially parallel to the axes of said working rolls and generally transverse to the direction of travel of the sheet material being worked, a plurality of fluid piston-cylinder units mounting said flexible subframe to the rigid frame at least two of said piston-cylinder units being located along a line substantially parallel to the axes of the working rolls, one of the cylinder or piston thereof being associated with said rigid frame and the other of the piston or cylinder being in contact with said flexible subframe, means to sense the position of said pistons in said cylinders and means to vary the fluid pressure above said pistons dependent upon variation of said piston positions from a predetermined position to compensate for the subframe distortion.

2. A sheet metal leveling machine as defined in claim 1, wherein at least some of said upper working rolls are provided with backing rolls in tangential rolling contact therewith and said backing rolls being journalled for rotation on said flexible subframe.

3. A sheet metal leveling machine as defined in claim 2, and further including an entry roll and a delivery roll journalled for rotation in said frame at the points of sheet material entrance and exit from the machine respectively, and a piston-cylinder unit mounting the flexible subframe to the rigid frame immediately adjacent said entry and delivery rolls to compensate for distortion imparted to said subframe by the entry and delivery rolls.

4. A sheet metal leveling machine as defined in claim 1, wherein the fluid is hydraulic oil and further including a supply resevoir for said oil, pump means for transferring oil under pressure to said cylinders and vent means to relieve cylinder oil pressure dependent upon variations of said piston position from said predetermined position.

5. A sheet material leveling machine as defined in claim 1, and further including hydraulic jack means on said rigid frame, and linkage means connecting said jack means to said flexible subframe for the purpose of biasing said subframe toward said rigid frame.

6. A sheet material leveling machine as defined in claim 5, and further including a main base frame on which said rigid frame is supported, screw jack means including a foot member for adjustably supporting said rigid frame on said main base frame, and piston-cylinder means for biasing said rigid frame against said foot member.

7. A sheet metal leveling machine as defined in claim 1, wherein the means to compensate for said distortion of the flexible subframe comprises a hydraulic system including a hydraulic oil reservoir motor-driven pump means for delivering oil from said reservoir, servo valve means in communication with said pump means, and having separate communication with said reservoir for return of hydraulic oil, and hydraulic line means connecting said servo valve means to its respective cylinder for injection of oil into and venting of oil from said cylinder; and said means to sense the piston position being operatively connected to said servo valve means.

8. A sheet metal leveling machine as defined in claim 7, wherein the means to sense the piston position comprises an electrical transducer probe extending into said cylinder and into contact with the piston head.

9. A sheet metal leveling machine as defined in claim 8, wherein said transducer provides an analog output signal having a voltage related to piston position, said machine further including a summing amplifier, the output thereof controlling said servo valve means, said amplifier having two inputs, one input being the output signal from the transducer, adjustable reference potentiometer means for each cylinder providing a bias voltage output signal to the second amplifier input, and wherein voltage subtraction is performed by said amplifier to pump oil into or vent oil from the cylinder as required.

10. A sheet metal leveling machine as defined in claim 9, wherein said analog output signal from the transducer is also fed to display means providing graphic representation of piston position.

11. A sheet metal leveling machine as defined in claim 9, and further including fluid pressure transducer means in each cylinder to monitor the pressure of the hydraulic oil therein and pressure display means connected to said pressure transducers providing graphic representation of cylinder pressure.

12. In a sheet metal leveling machine having a rigid frame, a plurality of substantially parallel work rolls journalled for rotation in said framework and extending across the width of the machine in two banks comprising an upper work roll set and a lower work roll set for applying working pressure on the face of the sheet material passing between said upper and lower roll sets, said upper and lower work roll set being offset relative to one another, a flexible beam subject to distortion due to forces imparted thereto by either of said sets of rolls, said flexible beam extending across said machine substantially parallel to the axes of said work rolls and generally transverse to the direction of travel of the sheet material being worked, a plurality of hydraulic cylinders formed in said rigid framework across said machine width above said upper roll set, a piston having a shaft extending therefrom mounted for reciprocation in each cylinder, said piston shafts being in contact with said flexible boam to cause piston movement corresponding to beam flexure, at least two of said cylinder being located along a line substantially parallel to the axes of the work roll sets, means in each cylinder to sense movement of its piston away from a predetermined position, and means to vary the hydraulic pressure in each cylinder above said pistons dependent on movement of said piston from a predetermined position to compensate for and correct beam distortion.

13. A sheet metal leveling machine as defined in claim 12, wherein at least some of said work rolls are driven for rotation.

14. A sheet metal leveling machine as defined in claim 12, and further including a driven entry roll and a driven delivery roll, each journalled for rotation in said framework at the points of sheet material entrance and exit respectively, and a cylinder and piston assembly in said framework immediately adjacent said entry and delivery rolls to compensate for movement of the entry and delivery rolls.

15. A sheet material leveling machine as defined in claim 12, and further including a backing roll for each of said upper work rolls, said backing rolls being journalled for rotation in said flexible beam and being located above and in tangential rolling contact with the respective work rolls.

16. A sheet material leveling machine as defined in claim 12, and further including hydraulic jack means on said rigid framework, and linkage means connecting said jack means to said flexible beam for the purpose of biasing said beam toward said framework.

17. A sheet material leveling machine as defined in claim 16 and further including a main base frame on which said rigid framework is supported, screw jack means including a foot member for adjustably supporting said rigid framework on said main base frame, and piston-cylinder means for biasing said rigid framework against said foot member.

18. A sheet material leveling machine as defined in claim 15, and further including a hydraulic oil reservoir, a supply line between said reservoir and each cylinder, a control valve means interposed between said reservoir and each cylinder, a hydraulic oil return line between said control valve and said reservoir, and a pump in the line between said reservoir and the control valve, said control valve being operable by the means to sense movement of the pistons to pump oil into said cylinder or vent oil out therefrom to compensate for the correct beam distortion.

19. A sheet material leveling machine as defined in claim 18 wherein the means to sense movement of the piston in each cylinder comprises an electrical transducer probe in contact with the associated piston.

20. A sheet material leveling machine as defined in claim 18 wherein said transducer probe provides an analog output signal having a voltage related to piston position, said machine further including a summing amplifier, the output therefrom operating said control valve to allow oil to flow under pressure into or to exhaust from the cylinder, each said amplifier having as one input, the output signal from the transducer, adjustable reference potentiometer means for each cylinder providing a bias voltage output signal serving as a second input to said amplifier, and wherein voltage subtraction is performed by said amplifier to determine its output.

21. A sheet material leveling machine as defined in claim 20, wherein the analog output signal from the transducer probe is also fed to display means to provide graphic representation of piston position.

22. A sheet material leveling machine as defined in claim 21, wherein said display means consists of a cathode ray tube video screen.

23. A sheet material leveling machine as defined in claim 20 and further including fluid pressure transducer means operatively associated with each of said cylinders to monitor the pressure of the hydraulic oil in each cylinder, and pressure display means connected to said pressure transducers to provide graphic representation of cylinder pressure.

24. A sheet material leveling machine as defined in claim 23, wherein said pressure display means consists of a cathode ray tube video screen.

* * * * *